United States Patent [19]

Gruber

[11] 4,275,746

[45] Jun. 30, 1981

[54] COMBINED INCENSE BURNER AND PIPE

[76] Inventor: Morton A. Gruber, 188 Haypath Rd., Old Bethpage, N.Y. 11804

[21] Appl. No.: 16,449

[22] Filed: Mar. 1, 1979

[51] Int. Cl.[3] ..... A24F 3/00; A24F 13/12

[52] U.S. Cl. ..... 131/180; 131/178; 131/214; 131/339

[58] Field of Search ..... 131/178, 180, 179, 186, 131/214, 170 R, 171 R, 240, 241; 220/22, 22.1, 22.3, 22.5; 422/126

[56] References Cited

U.S. PATENT DOCUMENTS

| | | | |
|---|---|---|---|
| 51,255 | 11/1865 | Breckenridge | 131/214 X |
| 121,935 | 8/1940 | Schiff | D27/3 |
| D. 245,992 | 10/1977 | Gruber | D23/78 |
| 3,079,028 | 2/1963 | Rosner | 220/22 |
| 3,765,426 | 10/1973 | Halaby | 131/180 X |

*Primary Examiner*—Stephen C. Pellegrino
*Attorney, Agent, or Firm*—Duffield & Lehrer

[57] ABSTRACT

An elongated rectangular box includes a removable bottom wall which carries an intermediate vertical wall running the length of the box. The intermediate wall divides the box into two compartments for storing a supply of stick incense. An incense burner is removably mounted on a pair of studs on the top of the box. With the incense burner removed, a pipe bowl may be placed over one of the studs which has a hole passing therethrough and into a passage in the box formed between the top of the intermediate wall and a channel on the underside of the top wall. Smoke may be drawn through the pipe by a mouthpiece removably attached to one end thereof.

13 Claims, 6 Drawing Figures

COMBINED INCENSE BURNER AND PIPE

BACKGROUND OF THE INVENTION

The present invention is directed toward a combined incense burner and pipe and more particularly toward a device which includes a plurality of replacement parts allowing the same to be selectively used either as a stick incense burner or as a pipe.

Stick incense burners have been known and used for many years. One example is shown in U.S. Pat. No. Des. 245,992. Co-pending design patent application Ser. No. 872,345 filed Jan. 25, 1978 shows a similar stick incense holder mounted on top of a box which may be used for storing a supply of stick incense.

Pipes for smoking tobacco and similar materials have also been known for many years. One common disadvantage of many conventional pipes is that they require the use of pipe holder. This is, if the user desires to temporarily place the pipe down on a table, a pipe holder is required since the conventional pipe normally will not remain in an upright position by itself.

Many people who enjoy the smell of incense burning are also pipe users. Heretofore, in order for them to enjoy both habits, it would have been necessary for them to purchase both an incense burner and a pipe. This, of course, created some additional expense.

SUMMARY OF THE INVENTION

The present invention has all of the advantages of the incense burner and holder shown in Applicant's co-pending design patent application described above and further overcomes the disadvantages of most conventional pipes described above. Even further, since the present device is useful as both an incense burner and a pipe, it would be less expensive than having to purchase two separate items. The foregoing is accomplished by an elongated rectangular box which includes a removable bottom wall which carries an intermediate vertical wall running the length of the box. The intermediate wall divides the box into two compartments for storing a supply of stick incense. An incense burner is removably mounted on a pair of studs on the top of the box. With the incense burner removed, a pipe bowl may be placed over one of the studs which has a hole passing therethrough and into a passage in the box formed between the top of the intermediate wall and a channel on the underside of the top wall. Smoke may be drawn through the pipe by a mouthpiece removably attached to one end thereof.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
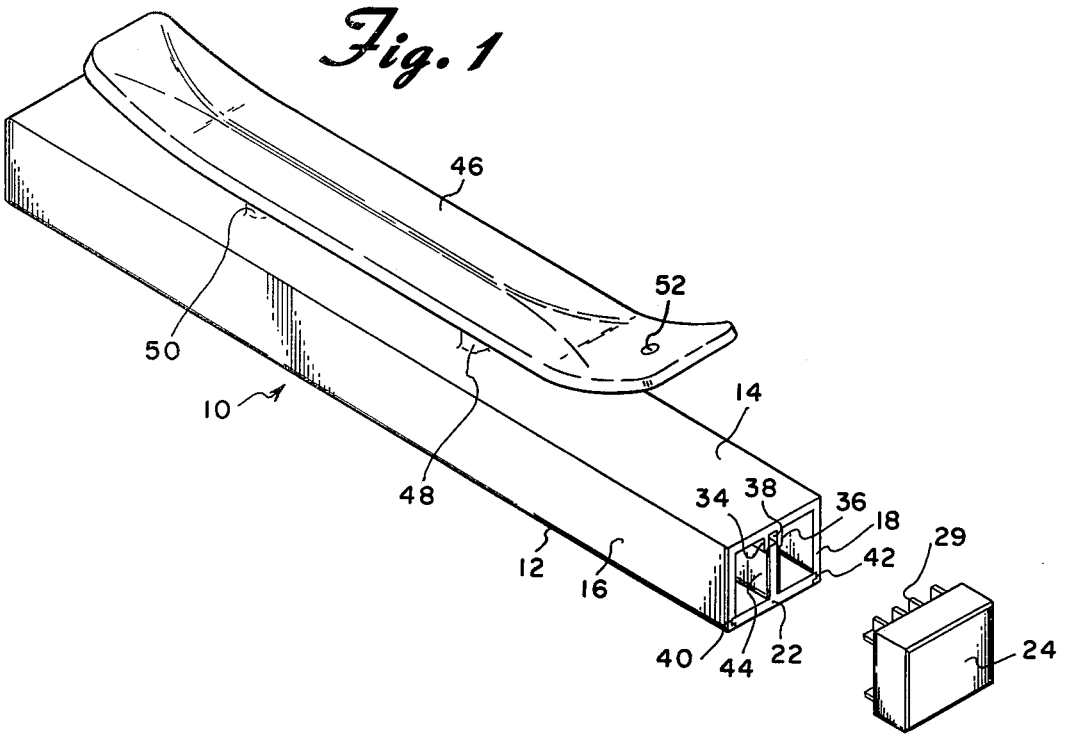
FIG. 1 is a perspective view of a device constructed in accordance with the principles of the present invention and being utilized as an incense burner.
Figure 3:
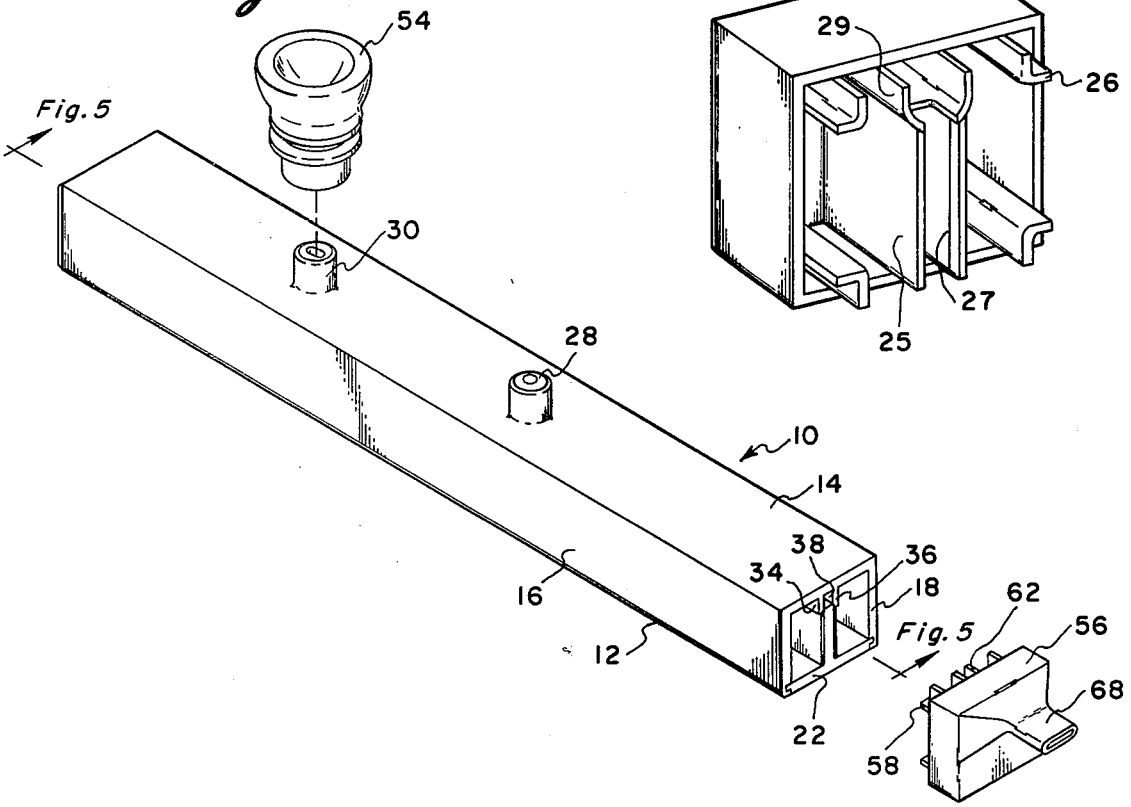
FIG. 3 is a perspective view showing the manner in which the device is used as a pipe.

Referring now to the drawings in detail wherein like reference numerals have been used throughout the various figures to designate like elements, there is shown in FIGS. 1 and 3 a combined incense burner and pipe constructed in accordance with the principles of the present invention and designated generally as 10. FIG. 1 shows the device being utilized as an incense burner and FIG. 3 illustrates the use of the device as a pipe.

Figure 2:
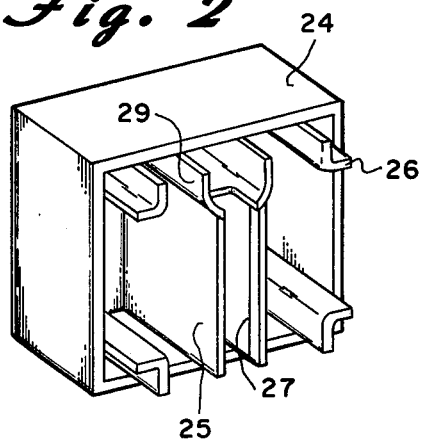
FIG. 2 is a perspective view of the rear side of the end cap shown in FIG. 1.

Device 10 includes a base comprised of an elongated rectangular box 12. Box 12 includes a top wall 14, a pair of perpendicular side walls 16 and 18, an end wall 20 and a bottom wall 22. The front end of the box 12 is opened but may be closed by removable end cap 24. As shown most clearly in FIG. 2, end cap 24 includes a plurality of pins 26 projecting from the rear thereof. These pins 26 are adapted to fit moderately tightly into the four corners of the box 12 so as to maintain the end cap 24 in position when desired. End cap 24 also includes devices for sealing the end of the box which will be described in more detail hereinafter.

Figure 6:
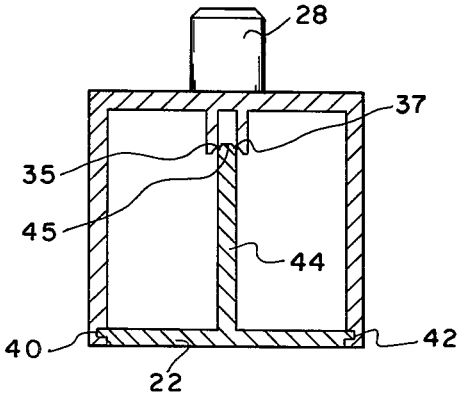
FIG. 6 is a cross sectional view taken through the lines 6—6 of FIG. 5.

As shown most clearly in FIG. 3, projecting upwardly from the top wall 14 of box 12 are a pair of studs 28 and 30. Studs 28 and 30 are substantially the same except that stud 30 includes an aperture 32 therein which passes into the interior of the box 12. In the interior of the box and extending downwardly from the top wall 14 and inwardly from the end wall 20 are a pair of guides 34 and 36. These guides are parallel to the side walls 16 and 18 and are spaced from each other so as to leave a channel 38 therebetween. Apeture 32 in stud 30 is in communication with the channel 38. The lower ends of guides 34 and 36 are tapered downwardly and outwardly as shown at 35 and 37. (FIG. 6).

Bottom wall 22 of box 12 is designed so as to be removable therefrom. In this regard, the longitudinal edges of the wall 22 include tongues 40 which are adapted to fit within complementary grooves 42 cut into the lower inside portions of side walls 16 and 18. Thus, it can be seen that bottom wall 22 can be removed when desired by merely sliding the same forwardly.

Bottom wall 22 also has mounted thereon and adjacent the center thereof a vertical divider wall 44. Wall 44 extends substantially the entire length of the bottom wall 22 and has a height which is less than the height of the side walls 16 and 18. The top of divider wall 44 is rounded at its corners such as shown at 45 so that when it is slid into the lowermost part of the channel 38, the top of wall 44 seals tightly against the tapers 35 and 37. While not shown in detail, the rear end of wall 44 similarly seals against similar tapers on the guides 34 and 36 mounted on the end wall 20. It shoudl be readily apparent that the top of divider wall 44 defines the lowermost part of channel 38. The divider wall 44 also functions to separate the interior of the box 12 into two compartments which may be used for storing two different incense sticks having different scents. These compartments are isolated from the channel 38 and from each other so that the incense in each compartment remains totally isolated from the other.

Referring again to FIG. 2, it can be seen that end cap 24 includes two walls 25 and 27 which are similar to guides 34 and 36 and which similarly seal against the forward end of divider wall 44. In addition, U-shaped channel member 29 fits around the ends of guides 34 and 36. Thus, it should be apparent that when end cap 24 is in place the same provides a complete seal at the end of the box 12 whereby the two compartments are totally isolated from each other and from the channel 38.

As shown in FIG. 1, the device of the present invention may be used as an incense burner. In this regard, a receptacle in the form of an incense burner 46 having legs 48 and 50 is positioned on the top wall 14 of box 12. Legs 48 and 50 have a diameter somewhat greater than studs 28 and 30 and are hollow so as to fit over the studs 28 and 30. This maintains the incense burner 46 in a stable position.

Incense burner 46 is made of a substantially flat sheet material and has each end thereof curved slightly upwardly. A hole 52 is formed in the surface of the forward end thereof which is used to support the stick of a stick incense which, as is known in the art, includes combustible incense material. Hole 52 is formed so as to be parallel with the length of the incense burner 46 so that the incense stick will be supported substantially horizontally and any ashes which fall from the burning incense stick will fall on to the upper surface of the incense burner 46. Incense burner 46 is shown in more detail in U.S. Pat. No. Des. 245,992.

When it is desired to use the device 10 as a pipe, incense burner 46 is removed from the top 14 of the box 12. The bottom of the legs 48 and 50 are preferrably sufficiently flat and of sufficient width so that the incense burner 46 may then be placed on any flat surface and continued to be used as an incense burner.

Figure 4:
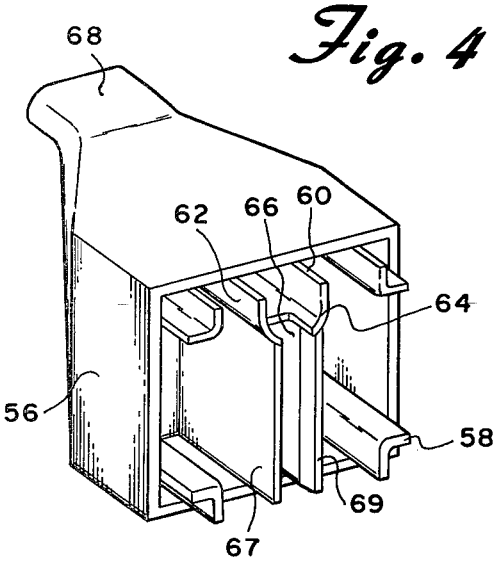
FIG. 4 is a perspective view of the reverse side of the mouthpiece shown in FIG. 3.
Figure 5:
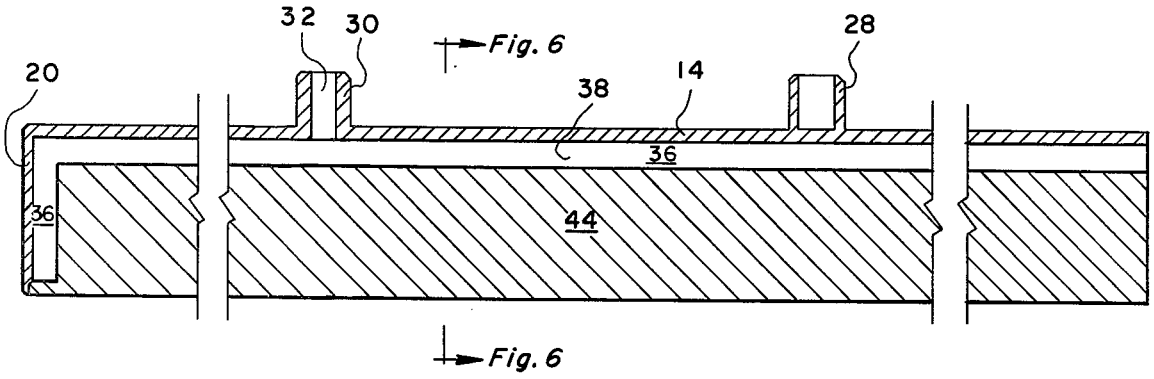
FIG. 5 is a cross sectional view taken through the lines 5—5 of FIG. 3.

With the incense burner 46 removed, a receptacle in the form of a pipe bowl 54 having an opening at the bottom thereof is placed over the stud 30. The opening at the top of bowl 54 is therefore in communication with the aperture 32 and the channel 38. End cap 24 is also removed from the end of the box 12 and is replaced by a mouthpiece cap 56. As shown most clearly in FIG. 4, cap 56 also includes a plurality of pins 58 similar to pins 26 of cap 24 which are adpated to hold the cap 56 in place in the end of the box 12. Also extending outwardly from the inside of the cap 56 is a substantially U-shaped channel member 60. Channel member 60 includes a pair of side walls 62 and 64 which are spaced from each other a distance substantially equal to the distance between the outside surface of guide members 34 and 36. Thus, when the cap 56 is in place on the end of box 12, channel 60 fits into the end of the box around guides 34 and 36. A cutout portion 66 is formed in the bottom wall of the U-shaped channel member 60 to accommodate the end of divider wall 44. With the mouthpiece cap 56 in place, the space within the U-shaped channel 60 is in communication only with channel 38. As with end cap 24, cap 56 includes walls 67 and 69 which seal against the end of divider wall 44 to isolate the two chambers from each other. Cap 56 also includes a mouthpiece portion 68 which, internally of cap 56, is in communication with the interior of U-shaped channel 60.

It should now be readily apparent that when the device 10 is being used as a pipe, tobacco or a similar combustible substance is placed into the bowl 54 and is ignited. Smoke from the tobacco is then drawn through the aperture 32 in stud 30, through the channel 38 into channel 60 and out through the mouthpiece 68. If it is ever desired to clean the interior of the pipe, it is only necessary to slide the bottom wall 22 along with the divider wall 44 out of the remaining portions of the box to thereby expose the channel 38 for easy cleaning.

The present invention may be embodied in other specific forms without departing from the spirit or essential attributes thereof and, accordingly, reference should be made to the appended claims rather than to the foregoing specification as indicating the scope of the invention.

I claim:

1. A smoking device comprising:

a substantially rectangularly shaped elongated box having a top wall, a pair of side walls, an end wall, a bottom wall and having the other end thereof open;

a removable end cap for substantially closing said open end;

said top wall including at least one stud on the exterior thereof extending upwardly, said stud having an aperture there through communicating with at least a portion of the interior of said box, means to support a smoking substance on said stem, an elongated divider wall means within said box, said divider wall means running substantially the entire length of said box and dividing the interior laterally into two substantially equal elongated compartments.

2. A device as claimed in claim 1 wherein said top wall further includes a pair of downwardly extending guide members on the interior surface thereof, said guide members contacting said divider wall means and extending substantially the entire length of said top wall and being spaced from each other so as to define a channel there between, said aperture communicating with said channel.

3. A device as claimed in claim 2 wherein said divider wall means includes an upwardly extending divider wall carried by said bottom wall and havng a length substantially equal to the length of said bottom wall and having a height less than the height of said side walls but sufficient so as to enter at least the lowermost part of said channel.

4. A device as claimed in claim 3 further including means allowing said bottom wall and said divider wall to be removed from said box.

5. A device as claimed in claim 1 wherein said support means is a pipe bowl adapted to be removably secured to said stud, said bowl having an opening therein adapted to communicate with said aperture.

6. A device as claimed in claim 5 wherein said end cap includes a mouthpiece adapted to communicate with said portion of the interior of said box.

7. A device as claimed in claim 1 further including an incense burner and means for temporarily interconnecting the bottom of said incense burner to the top of said box.

8. A device as claimed in claim 7 wherein said incense burner is comprised of an elongated relatively flat member having each end thereof curved slightly upwardly, a hole being formed in said member adjacent one end thereof for supporting an incense stick.

9. A device as claimed in claim 1 wherein said support means is a receptacle means adapted to be removably secured to said stud and further adapted to hold combustible material.

10. A device as claimed in claim 9 wherein said receptacle is a pipe bowl, said pipe bowl having an opening therein adapted to communicate with said aperture and wherein said end cap includes a mouthpiece.

11. A device as claimed in claim 9 wherein said receptacle is an incense burner.

12. A device as claimed in claim 1 wherein said support means is either a pipe bowl or an incense burner, said pipe bowl and said incense burner being alternately and selectively removably secured to said stud.

13. A smoking device comprising:

a substantially rectangularly shaped elongated box having a top wall, a pair of side walls, an end wall, a bottom wall and having the other end thereof open;

a removable end cap for substantially closing said open end;

said top wall including at least one stud on the exterior thereof extending upwardly, said stud having an aperture there through communicating with at least a portion of the interior of said box;

a pipe bowl, said pipe bowl having means at the bottom thereof allowing the same to be removably secured to said stud and including an opening therein adapted to communicate with said aperture;

an incense burner comprised of an elongated relatively flat member having each end thereof curved slightly upwardly, a hole being formed in said member adjacent one end thereof for supporting an incense stick, said incense burner having means at the bottom thereof allowing the same to be removably secured to said stud;

said pipe bowl and said incense burner being alternately and selectively adapted to be removably secured to said stud.

* * * * *